United States Patent [19]

Liebman et al.

[11] 4,284,144

[45] Aug. 18, 1981

[54] PASSIVE EXPLOSION BARRIER FOR MINES

[75] Inventors: Israel Liebman, Library; John Corry, Elrama; Richard Pro, Pittsburgh, all of Pa.

[73] Assignee: The United States of America as represented by the Secretary of the Interior, Washington, D.C.

[21] Appl. No.: 81,505

[22] Filed: Oct. 3, 1979

[51] Int. Cl.[3] ..... A62C 35/04

[52] U.S. Cl. ..... 169/64; 169/29; 405/303

[58] Field of Search ..... 405/303, 132–136, 405/150, 151, 288; 299/7–11; 169/29, 64, 60, 54

[56] References Cited

U.S. PATENT DOCUMENTS 3,960,217 6/1976 Liebman et al. ..... 169/29 X

FOREIGN PATENT DOCUMENTS 325225 9/1920 Fed. Rep. of Germany ..... 169/64

325227 9/1920 Fed. Rep. of Germany ..... 169/64

1280184 10/1968 Fed. Rep. of Germany ..... 169/64

*Primary Examiner*—Dennis L. Taylor

*Attorney, Agent, or Firm*—Thomas Zack; Donald A. Gardiner

[57] ABSTRACT

A passive explosion barrier is provided for use in mining operations in suppressing mine explosions. The barrier basically comprises a receptacle or tub which contains an explosion suppressing substance, such as water, and is mounted on a frame adjacent to the roof of the mine. The tub includes a pair of integral support lips at the front and rear edges thereof which are beveled at the sides and which constitute the sole support for the tub. In operation, wind from an explosion will cause the lip disposed toward the explosion to distort and curve inwards and disengage from the frame so that the tub falls, pivoting about the other lip. In an alternative embodiment, the sides of the tub are more flexible than the lips of the tub, and distortion of the sides in response to wind forces causes disengagement of the lip facing the explosion.

3 Claims, 6 Drawing Figures

PASSIVE EXPLOSION BARRIER FOR MINES

FIELD OF THE INVENTION

The present invention relates generally to explosion barriers for mines or the like, and more particularly to an improved passive explosion barrier that is responsive to relatively low velocity, as well as intermediate and high velocity explosion-generated wind, and is non-responsive to relatively small accidental disturbances.

BACKGROUND OF THE INVENTION

In order to suppress an explosion in an underground coal mine, explosion barriers are presently employed to release explosion suppression substances, such as water, into the path of the explosion. The explosion suppressing substance stops propagation of the flame.

The types of explosion barriers are generally classified as being either (a) triggered or (b) passive.

Triggered barriers typically use optical and/or electronic devices to sense the flame accompanying an explosion and set off explosives or open high pressure containers to rapidly expel the explosion suppressing substance. The flame sensor is mounted between the explosion source and the suppressant container to allow time for the suppressing agent to be discharged prior to arrival of the flame. These devices are extremely fast acting and require less suppressant material to stop an explosion than the passive barrier. While generally satisfactory, such triggered barriers are expensive and require a substantial amount of maintenance to insure their proper operation.

Passive barriers typically comprise a receptacle containing the explosion suppressing substance, such as water. The receptacle is placed on a platform or in a frame located beneath the mine roof.

In operation, the receptacle is blown off the platform or pulled out of the frame by the strong air current which precedes an explosion. The suppressant is then dispersed into the path of the explosion.

While generally satisfactory for explosions causing moderate to high wind speeds (in excess of 250 ft./sec.), passive barriers of this type are ineffective in suppressing slow moving explosions. More specifically, the slow moving wind is not capable of spilling the contents of the barrier. Accordingly, passive barriers of this type are generally located no nearer than approximately 160 ft. from the explosion source.

A prior passive explosion barrier of particular interest here is that disclosed in U.S. Pat. No. 3,960,217 (Liebman et al). The explosion barrier disclosed in that patent comprises a receptacle containing an explosion suppressing substance mounted on a pair of beams adjacent the mine roof with a pair of support flanges. The first flange is formed on the upper edge or rim of one side of the receptacle. The other flange is formed on the upper edge of a face plate hinged to the base of the receptacle on the side thereof opposite the first flange. With the barrier mounted on the beams, the face plate is angled away from the receptacle, oblique to a horizontal plane. Friction between the face plate flange and beam prevents the flange from slipping from the beam due to accidental disturbances. However, a wind generated by an explosion will act against the face plate and create forces tending to both lift the plate and pivot it against the receptacle. The lift reduces the friction between the face plate flange and beam causing the face plate to more easily pivot against the receptacle and slip from the beam in response to relatively low velocity wind.

The chief disadvantage of the barrier device of the Liebman et al patent is cost. Thus, while the cost is substantially decreased as compared with triggered barriers, the barrier device of the Liebman et al patent is relatively complicated and expensive to construct.

SUMMARY OF THE INVENTION

In accordance with the invention, an improved passive explosion barrier is provided which provides the advantages of the barriers of the prior art but which overcomes the disadvantages. In particular, the construction of the device of the invention is considerably simpler than that of the barrier of the Liebman et al patent and is substantially less expensive to make.

In accordance with a preferred embodiment, a passive explosion barrier arrangement is provided for use in mining operations in suppressing explosions in a mine, which arrangement comprises a frame comprising a pair of spaced, longitudinal frame members that, in use, extend longitudinally in the direction of the wind that would be created by an explosion, and first and second spaced transverse frame members located between and connected to the longitudinal frame members so as to form an opening therein and a flexible tub-like receptacle mounted in the frame within the opening and containing an explosion suppressing substance such as water therein. The receptacle includes first and second integral lips formed on opposite edges thereof which engage the first and second transverse frame members and constitute the sole means for supporting the receptacle on said frame. During an explosion, the wind forces distort the lip facing the explosion, curving it back off the transverse frame members to disengage the receptacle from the frame. In this embodiment, at least one of said lips is beveled at the sides thereof adjacent the side walls of the receptacle so as to increase the sensitivity of the response of the barrier to low speed winds. It will be appreciated that this construction is substantially simplified as compared with that of the Liebman et al patent although as will be discussed below, the net effect of the operation of the two devices is substantially the same.

In a second preferred embodiment, the lips and front and rear walls of the receptacle are made to be stiffer than the side walls so that the latter distort in response to the wind current from an explosion so as to decrease the effective length of the receptacle, thereby permitting the lip facing the explosion to disengage from the frame.

Other features and advantages of the invention will be set forth in, or apparent from, the detailed description of the preferred embodiments found hereinbelow.

BRIEF DESCRIPTION OF THE DRAWINGS

FIG. 1(*b*) is the same perspective view with a portion broken away, illustrating the arrangement at a time after the force of the wind from an explosion has begun to distort the tub lips;

DESCRIPTION OF THE PREFERRED EMBODIMENTS

Figure 1A:
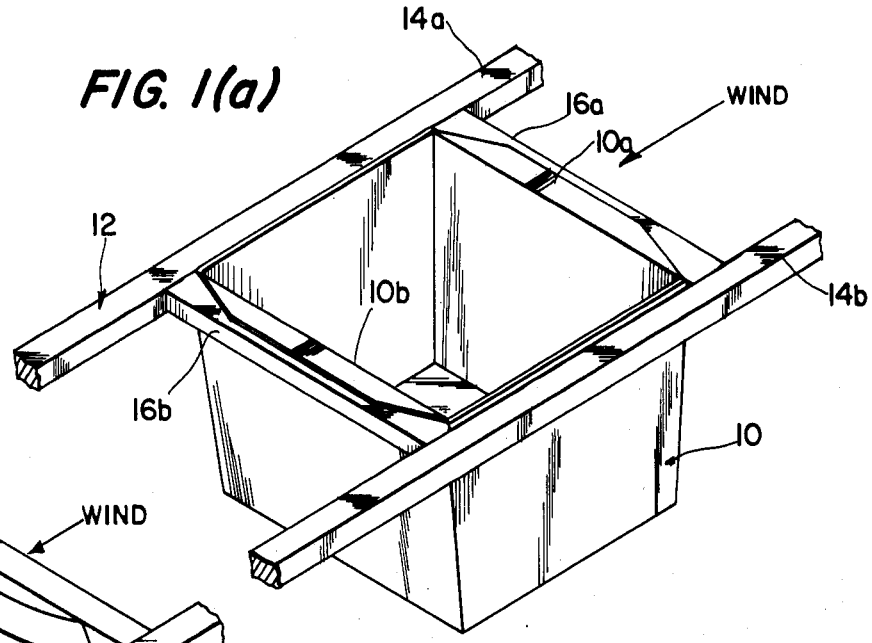
FIG. 1(*a*) is a perspective view of a first embodiment of an explosion barrier arrangement in accordance with the invention.
Figure 1B:
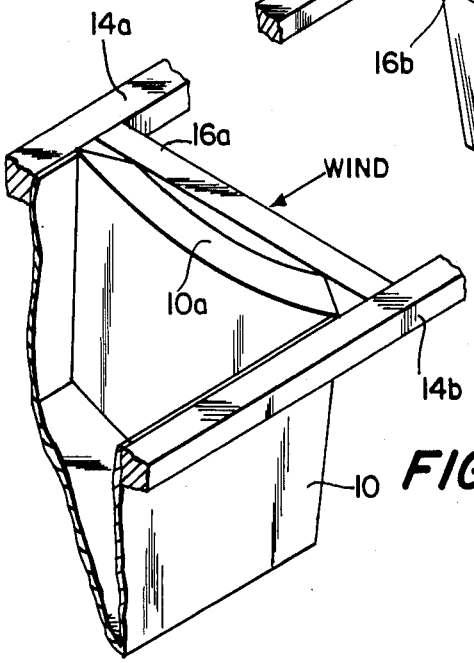

Referring to FIG. 1(*a*), a passive barrier constructed in accordance with the invention is shown in the operative position thereof. The barrier comprises a tub-like receptacle or tub 10 which is adapted to be mounted on a metal frame assembly or frame 12. The frame 12 includes a pair of longitudinally extending frame members 14*a* and 14*b* which extend parallel to the longitudinal axis of the mine entry and to the direction of the wind which would be created by an explosion. The frame 12 also includes transversely extending frame members 16*a* and 16*b* which together with frame members 14*a* and 14*b* form an opening in which the tub 10 is mounted.

The principal feature of this invention is the provision of a novel lip support for the tub 10. The lip support is comprised of a pair of flanges or lips 10*a* and 10*b* which are integral with the tub 10 at the "front" and "rear" edges thereof. As stated above, because of this feature, the barrier can operate at low wind speeds and thereby be effective in suppressing weak coal dust explosions. In a preferred embodiment, tub 10 is made of polyvinylchloride and holds approximately 170 lbs. of water although it will be understood that the size is not critical and that other plastics can be substituted. The tub 10 is supported by means of front and rear lips 10*a* and 10*b* resting on the metal frame 12. Frame 12 is fabricated from 1 inch wide by 1½ inch high tubing. The tub lips 10*a*, 10*b* are sufficiently strong to carry the water filled tub. The clearance space between the tub walls and inside of the metal frame should be approximately 1/16 inch.

In practice, a plurality of water filled tubs are mounted in rows of two or more near the roof of a mine roadway. A number of such rows of tubs, located 50 to 100 feet apart along a mine entry, would constitute an overall barrier system. During an explosion, the wind generated ahead of the propagating flame exerts a force on each tub 10 to force the tub 10 out of its supporting frame 12. This releases the water into the wind for dispersion so as to quench the approaching flame.

In a specific example of the operation of the tub illustrated in the first embodiment of FIG. 1(*a*) during an explosion, a water filled tub was mounted outside the open end of a large cylindrical explosion gallery 6½ feet in diameter by 100 feet long. The wind force acting on the tub was generated by a methane-air explosion initiated at the opposite closed end of the gallery. It was observed that 30 msec after the onset of the wind force from the explosion, the tub face and supporting lip had curved inwardly at the center, although the front lip 10*a* had still not become completely free of the metal frame member 16*a*. Subsequent, continued movement of the lip 10*a* caused the beveled lip edge 10*a* to be free of the support frame member 16*a* as shown in FIG. 1(*b*) so that the tub fell. It is noted that the beveling of the lip described above has a minimal effect on the strength of the lip in carrying the water-filled tub, but allows the tub to fall free at a minimum of distortion of the lip. If not beveled, the ends of the lip 10*a* would hang with more tenacity onto the metal frame member 16*a* and a much higher wind speed would be necessary to release the tub. As the tub falls, water is spilled and dispersed by the wind and the tub is deformed further, the sides of the tub 10 also buckling inwardly. The tub 10 drops in a swinging arc, pivoting around its rear tub lip 10*b* which is forced against the metal frame member 16*b* by the wind. This method of fall insures that all of the water will be released into the wind for dispersion and the water will not be carried with the tub as the tub falls to the mine floor. The latter, inferior operation is observed when commercial water barrier tubs are supported on shelves. The water from tub 10 is dispersed into a fine droplet spray and this spray spreads rapidly attaining diameters of over 10 feet at a distance of 10 feet beyond the tub. To be effective against an explosion, the water spray should blanket the entire mine roadway cross section prior to the flame arrival.

In additional tests, the tub of the invention was mounted inside the explosion gallery referred to at distance of 6 feet from the open end and a wind force was again generated by a methane-air explosion. A hot wire anemometer, positioned 1 foot in front of the tub, was used to measure wind speed. A thin wire attached between the lip of the tub and metal support frame indicated during breakage when the tub began to fall. Three metal supporting frames, each having a different inside dimension, were used in the tests; in the first, the clearance space between the tub walls and metal frame was 1/16 inch; the second, ⅛ inch; and the third, 3/16 inch. The test results indicated that wind speeds of 100 to 145 ft./sec. are necessary to drop the tub, with the tighter fitting frame apparently requiring increased wind speeds.

High speed movies of the operation of the tub during a wind force indicate little or no movement of the base of the tub 10 during early motion of the support lip 10*a*. An expression describing the torque, L, exerted by the wind on the face of the tub about a pivot at its base is:

$$L=\tfrac{1}{2}\rho CA\ V^2h/2 \qquad (1)$$

where C is the drag coefficient (assumed to be 1.0), A is the vertically projected area of the tub face (about 350 $in^2$), $\rho$ is the air density (0.081 lbs./$ft.^3$), V is the wind velocity in feet per second, and h is the vertically projected height of the tub face (11 inches).

When a static horizontal force was applied to the lip of the water filled tub, the required force to drop the tub ranged from 20 lbs. for the loose fitting metal frame (3/16 inch clearance between the tub wall and frame), to 30 lbs. for the tighter fitting frame (1/16 inch clearance). The torque in this case would be the product of the static force, f, and the tub height, $$L=fh \qquad (2)$$

Combining expressions (1) and (2) and solving for V results in wind speeds of 110 and 140 ft./sec. for static forces of 20 and 30 lbs. This agrees surprisingly well with the measured wind speeds referred to above.

When the tub is mounted in a mine entry, the chance of the tub being accidentally bumped and upset by personnel or equipment must also be considered. For this determination a static horizontal force was applied to the face of the water filled tub near its base. The upset force for all three supporting frames was approximately 75 lbs. and indicates that the tub would be relatively safe from accidental upsets.

It should be noted that the supporting lips 10*a* and 10*b* on the front and rear edges of the tub are similar and the tub will, therefore, respond equally to an explosion propagating from either direction. Thus, the terms "front" and "rear" are relative.

It is also pointed out that during their early stage of propagation, coal dust explosions are usually slow moving—less than 250 ft./sec.—and require "run up" distances of several hundred feet to develop into strong explosions. The barrier of the invention, because it operates at a relatively low wind speed, will respond effectively during the early stages of explosion development and can therefore be located at distances as close as 100 feet from an expected initiation source.

The water tub was also tested in the U.S. Bureau of Mines Experimental Mine at Bruceton, Pa. and found to operate satisfactorily against coal dust explosions. In several trials, two water filled tubs were mounted 300 feet from the explosion initiation. Barrier operation and water discharge began when the velocity of the explosion-generated winds reached about 125 ft./sec.; the explosions were stopped after propagating less than 150 feet past the barrier.

Figure 2A:
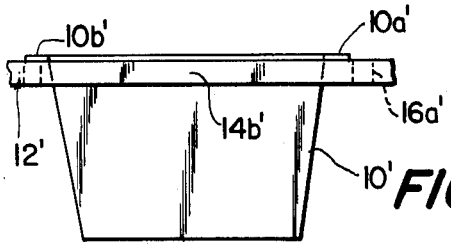
FIGS. 2(*a*) and 2(*b*) are side elevational and plan views, respectively, of a second embodiment of the explosion barrier arrangement of the invention, illustrating the arrangement at a time just after the force of the wind from an explosion has begun to distort the barrier tub.
Figure 2B:
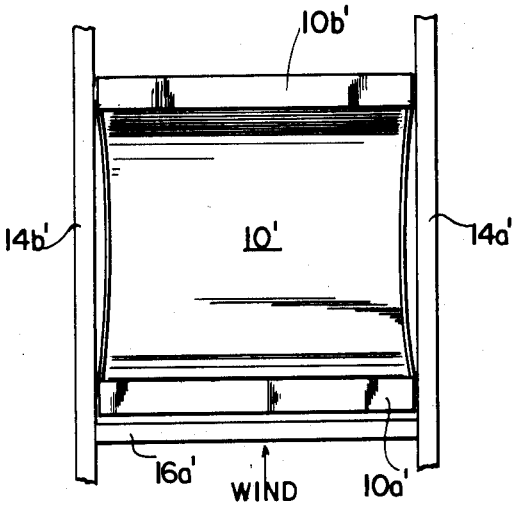
Figure 3A:
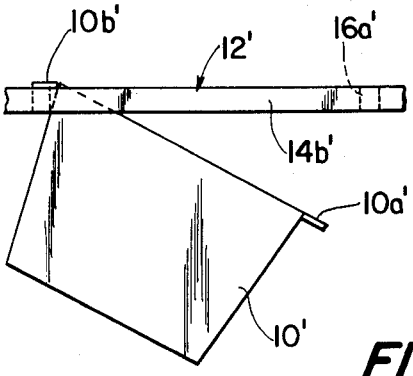
FIGS. 3(*a*) and 3(*b*) are side elevational and plan views, respectively, of the embodiment of FIGS. 2(*a*) and 2(*b*), illustrating the arrangement at a subsequent time.
Figure 3B:
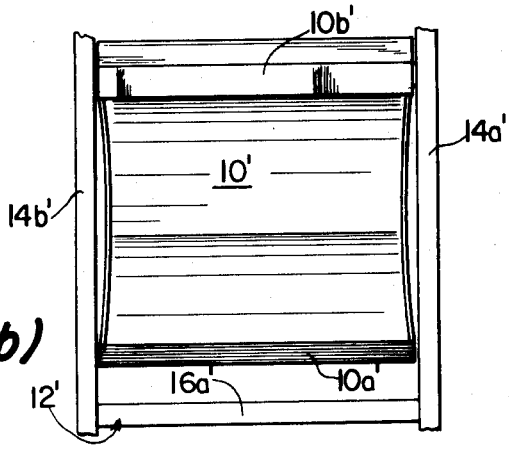

In an alternative embodiment of the invention illustrated in FIGS. 2(*a*), 2(*b*) and 3(*a*), 3(*b*) the stiffness of the front and rear faces of tub 10' and of supporting lips 10*a'*, 10*b'* is increased and the stiffness of the tub sides is decreased. This embodiment is similar to that of FIG. 1(*a*) and corresponding elements have been given the same numbers with primes attached. In this embodiment, during the onset of a wind, the support tub lip 10*a'* will remain straight, not changing its shape as it moves forward off the metal frame member 16*a'*. As illustrated in the drawings, the sides of the tub will yield to the tub lip motion by buckling or curving inwards. In FIGS. 2(*a*) and 2(*b*) the wind has arrived to move the tub lip 10*a'* off the frame member 16*a'* and the sides of the tub 10' move inwardly to accomodate the lip motion. In FIGS. 3(*a*) and 3(*b*) the tub 10' has fallen as the tub side walls are further distorted. Beveling the tub support lips 10*a'*, 10*b'* is not necessary for this embodiment.

Although the invention has been described with respect to exemplary embodiments thereof, it will be understood that variations and modifications can be effected in the embodiments without departing from the scope or spirit of the invention.

We claim:

1. A passive explosion barrier arrangement for use in mining operations in suppressing explosions in a mine, said barrier arrangement comprising a frame mounted to the roof of the mine and comprising a pair of spaced longitudinal frame members which, in use, extend longitudinally in the direction of the wind that would be created by an explosion and first and second spaced transverse frame members located between and connected to said longitudinal frame members which define an opening therein, and a flexible tub-like receptacle mounted in the frame within said opening and containing an explosion suppressing substance therein, said receptacle including first and second integral lips formed on opposite edges thereof which engage said first and second transverse frame members and constitute the sole means for supporting said receptacle on said frame, such that wind forces during an explosion will distort the lip facing the explosion and cause curving of the lip back off the transverse frame member so as to disengage the receptacle from the frame, at least one of said lips being beveled at the sides thereof adjacent the side walls of the receptacle so as to increase the sensitivity of the response of the barrier to low speed winds.

2. An arrangement as claimed in claim 1 wherein said frame is constructed of metal and said receptacle is constructed of plastic, said explosion suppressing substance comprising water.

3. A passive explosion barrier arrangement for use in mining operations in suppressing explosions in a mine, said barrier arrangement comprising a frame comprising a pair of spaced, longitudinal frame members which, in use, extend longitudinally in the direction of the wind that would be created by an explosion and first and second spaced transverse frame members located between and connected to said longitudinal frame members so as to form an opening therein, and a flexible tub-like receptacle mounted on said frame within said opening and containing an explosion suppressing substance therein, said receptacle including first and second integral lips formed on opposite edges thereof which engage said first and second transverse frame members and constitute the sole means for support of said receptacle on said frame, said receptacle including side walls which extend parallel to the longitudinal frame members and which are of greater flexibility than the lips and other walls so that the side walls will distort in response to the wind from an explosion so as to decrease the effective length of the receptacle and thereby permit the lip facing in the direction of the explosion to disengage from the frame.

* * * * *